US005251338A

United States Patent [19]

Light

[11] Patent Number: 5,251,338

[45] Date of Patent: Oct. 12, 1993

[54] TOILET HEIGHT CONVERSION APPARATUS

[76] Inventor: Homer E. Light, 9 E. Jefferson Ave., Myerstown, Pa. 17067

[21] Appl. No.: 907,903

[22] Filed: Jul. 2, 1992

Related U.S. Application Data

[63] Continuation-in-part of Ser. No. 734,600, Jul. 23, 1991, abandoned.

[51] Int. Cl.[5] ..... A47K 13/00

[52] U.S. Cl. ..... 4/235; 4/254

[58] Field of Search ..... 4/235, 239, 254

[56] References Cited

U.S. PATENT DOCUMENTS

| | | | |
|---|---|---|---|
| 2,732,566 | 1/1956 | Braelheide | 4/239 |
| 2,774,975 | 12/1956 | Frank | 4/254 |
| 3,670,441 | 6/1972 | Blount | 4/235 X |
| 3,971,077 | 7/1976 | O'Neil | 4/239 |
| 4,517,689 | 5/1985 | Smith et al. | 4/235 |

FOREIGN PATENT DOCUMENTS

| | | | |
|---|---|---|---|
| 2643249 | 8/1990 | France | 4/239 |

*Primary Examiner*—Charles E. Phillips
*Attorney, Agent, or Firm*—Michael F. Petock

[57] ABSTRACT

A toilet height conversion apparatus including a mounting block and a pivotally-connected raisable elevator, wherein the outer curvilinear surface of the elevator and mounting block substantially conform to the shape of an existing toilet, and the mounting block and elevator in the lowered position present the appearance of a toilet having a greater height. The conventional toilet seat and lid may be mounted onto the mounting block and toilet in the conventional manner utilizing extension bolts. The unit presents a pleasing appearance and has sanitary, including a forward splash shield and lateral drip edges on the elevator, as well as a gasket between the mounting block and the toilet. The elevator may be readily raised for cleaning of the toilet.

21 Claims, 5 Drawing Sheets

58
42
56
23
24
41
40
37
32
54
39
30
22
64
28
24a
52
26
60
29
18
27
20a
44
56
62
20
12
23
66

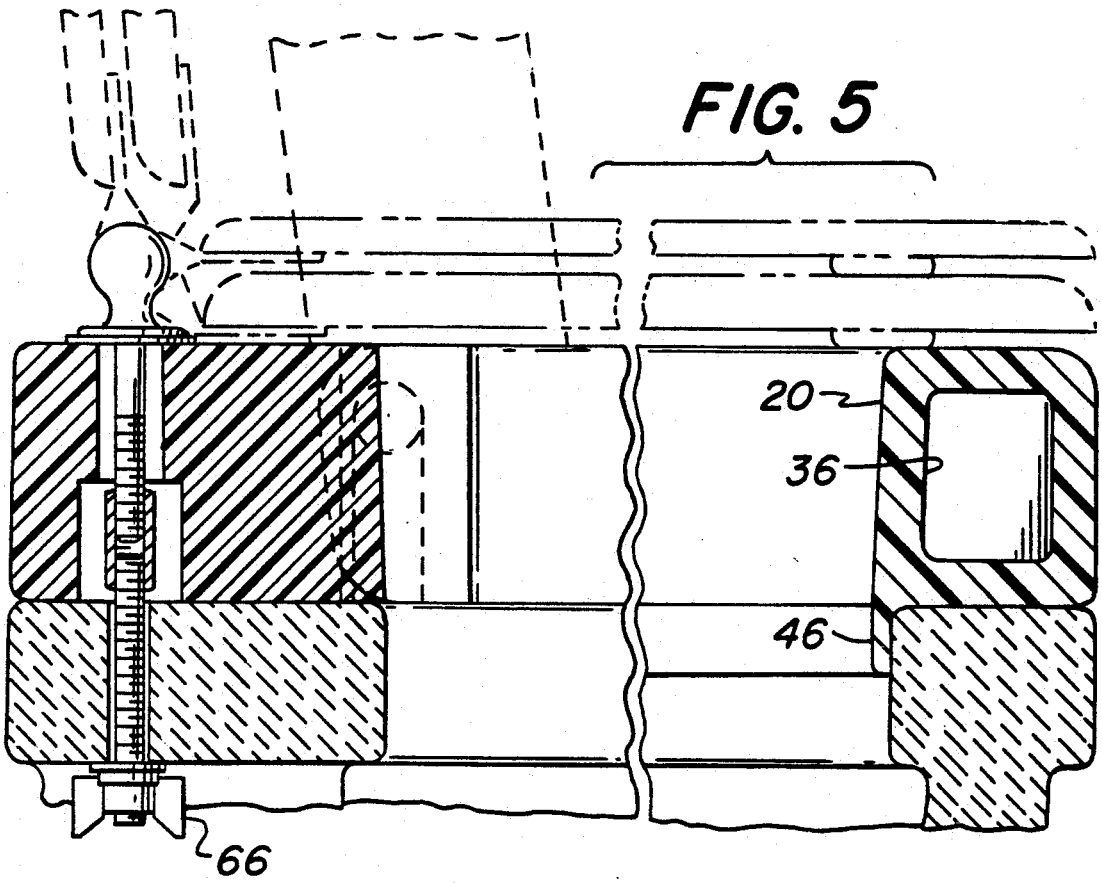
FIG. 5
20
36
46
66
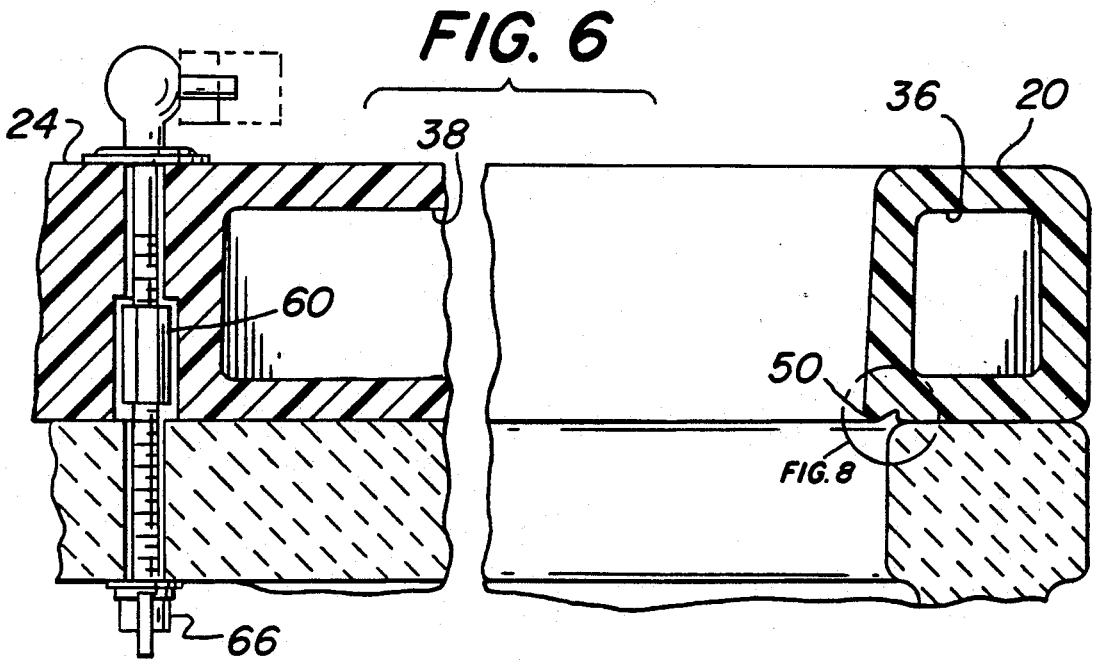
FIG. 6
24
38
36
20
60
50
FIG. 8
66

TOILET HEIGHT CONVERSION APPARATUS

CROSS-REFERENCE TO RELATED APPLICATION

This application is a continuation-in-part application of U.S. patent application Ser. No. 07/734,600, filed Jul. 23, 1991 by the inventor and entitled COMMODE ELEVATOR now abandoned. The benefit of the filing date of my earlier application is claimed for so much as is common in these applications.

The teachings of my prior patent application are incorporated herein by reference to same as if set forth at length.

BACKGROUND OF THE INVENTION

The present invention relates to a toilet height conversion apparatus. More particularly, the present invention relates to a toilet height conversion apparatus which presents the appearance of a toilet with a higher bowl, and which is adapted to receive a conventional toilet seat and lid.

There exists a need for a significant minority of the population for a toilet or commode which is greater than the conventional approximately fourteen inches off of the floor. These people include various persons with disabilities, a significant number of elderly persons, and the like. This need has been recognized for some time. Various attempts have been made over the years to provide what is often referred to as a toilet seat elevator for toilets. For example, see U.S. Pat. No. 4,213,211 Bemis et al.; U.S. Pat. No. 2,980,922 Taylor; and U.S. Pat. No. 4,477,932 Lenosky. Bemis et al. disclose a toilet seat elevator which utilizes a metal bracket to attach the elevator to the top of the toilet bowl. The toilet seat then bolts to the elevator. Taylor similarly discloses a toilet seat elevator which is hinged to the top of the toilet bowl by a metal hinge, with the toilet seat being attached to a projection on the elevator. Lenosky discloses a raised toilet seat which is superimposable on the bowl of the toilet only when the lid and seat are in a raised position. The Lenosky structure does not allow closure of the toilet by means of the lid when the raised seat is in position.

SUMMARY OF THE INVENTION

The present invention provides a number of significant advantages over the prior art. The toilet seat elevators of the prior art are often conceived by many as "unsightly contraptions". The present invention provides a contoured appearance, making an existing toilet look substantially as though it were a toilet of a greater height with a normal toilet seat and normal lid, usable in the conventional manner.

The present invention provides the advantage of being able to utilize and install the conventional toilet seat and lid structure on the conventional toilet with the apparatus of the present invention, converting it from the standard of approximately fourteen inch height to a height of 17 inches or more.

The present invention provides the advantage of providing a structure for converting the toilet height, in which all exposed and visible components may be constructed of a chemical-resistant plastic which has been molded into a hollow core form.

The present invention provides an apparatus in which the conventional toilet seat and lid may be utilized in the conventional manner, both being raised to enable the toilet to be utilized as a urinal, and further, allowing the elevator structure to be raised for easy cleaning.

Briefly and basically, in accordance with the present invention, a toilet height conversion apparatus is provided which includes a mounting block having a predetermined height. The mounting block is provided with holes therethrough such that the mounting block may be mounted to the upper rear surface of toilet along with a toilet seat, utilizing the holes provided in the toilet for the mounting of the toilet seat. The apparatus further includes a generally U-shaped member having a height substantially the same as the height of the mounting block with a mating structure for pivotally connecting to the pivotal connection structure of the mounting block. In a preferred embodiment, both the mounting block and the generally U-shaped member are made of a chemically-resistant plastic.

Additionally, the preferred embodiment may utilize projecting pins on the ends of the U-shaped members to mate with recesses in channels on the mounting block to form the pivotal connection.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

FIG. 5 is a cross-sectional view, partially broken away, taken along line 5—5 of FIG. 1, and also showing the elevator or generally U-shaped member, as well as the toilet seat and lid in the raised condition.

FIG. 6 is a cross-sectional view, partially broken away, taken along line 6—6 of FIG. 1.

DETAILED DESCRIPTION OF THE PREFERRED EMBODIMENTS

Figure 1:
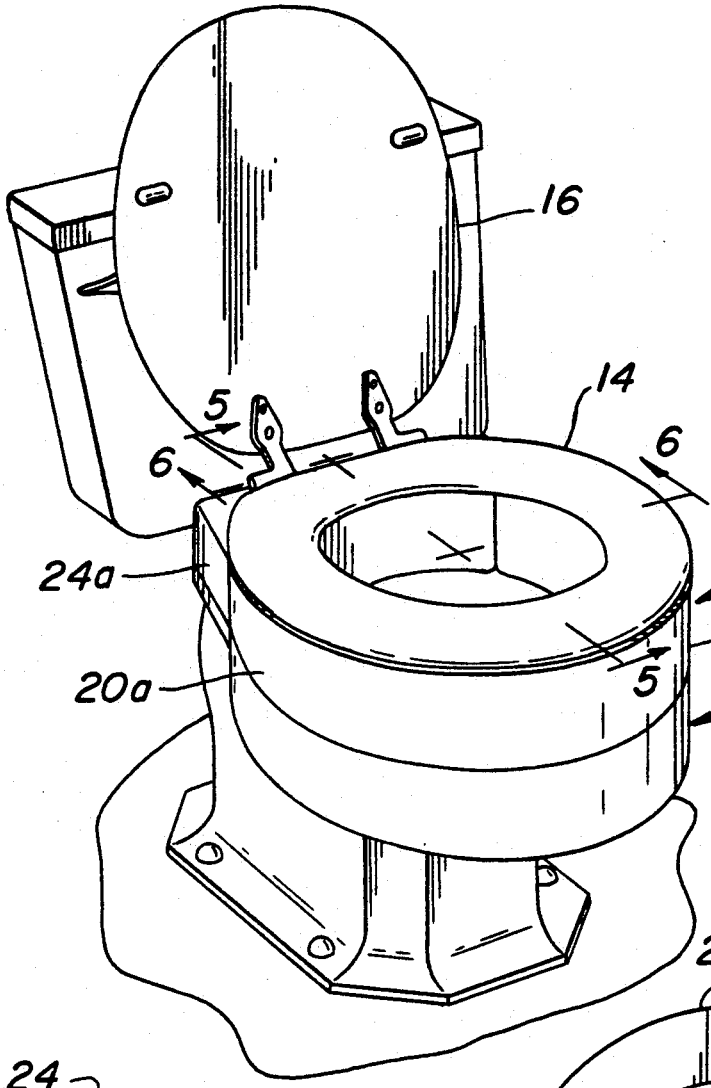
FIG. 1 is a view in perspective of the apparatus of the present invention mounted on a conventional toilet utilizing a conventional toilet seat and lid.

Referring now to the drawings, wherein like numerals indicate like elements, there is shown in FIG. 1 a toilet height conversion apparatus 10 mounted on a conventional toilet 12. A conventional toilet seat 14 and lid 16 are also mounted thereon.

Referring now collectively to FIGS. 1 through 6, the toilet height conversion apparatus 10 is comprised of a generally U-shaped member or elevator 20 having ends 18 and 22. When assembled, the generally U-shaped member 20 is pivotally connected to a mounting block or hinge piece 24. The ends of the generally U-shaped member 20 are pivotally connected to the mounting block 24 by means of projecting pins 26 and 28 on U-shaped member 20, which are engaged in recesses or detents 30 and 32 formed in mounting block 24. As may be seen best in FIGS. 1, 3, 5 and 6, the mounting block 24 is of substantially the same height as the generally U-shaped member or elevator 20.

In a presently preferred embodiment, elevator 20 and mounting block 24 are preferably molded from a chemically-resistant plastic, such as a low density polystyrene. In a presently preferred embodiment, the elevator 20 and mounting block 24 would preferably be molded by a hollow core molding process forming hollow areas such as 36 in elevator 20, and 38 in mounting block 24. However, it is understood that other suitable materials may be utilized in practicing the present invention, including high density polystyrenes, acetates, nylons, other synthetics and wood which may be painted with a chemically-resistant paint. However, in a presently preferred embodiment, the hollow core molding utilizing a chemically-resistant plastic provides a sturdy, chemically-resistant product which is lightweight, and provides a pleasing appearance closely approximating the appearance of conventional toilets and toilet seats.

Figure 2:
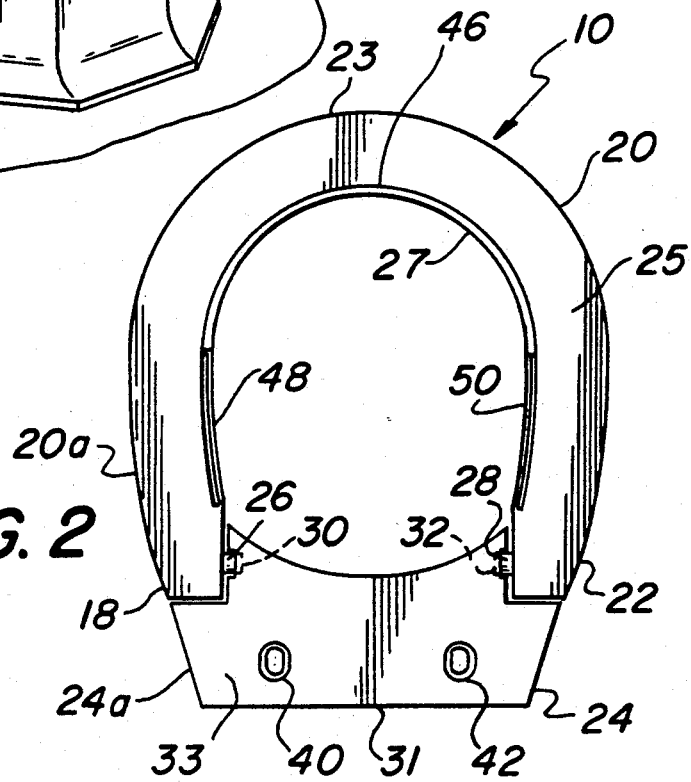
FIG. 2 is a plan view, viewed from the bottom, of the apparatus of the present invention.
Figure 3:
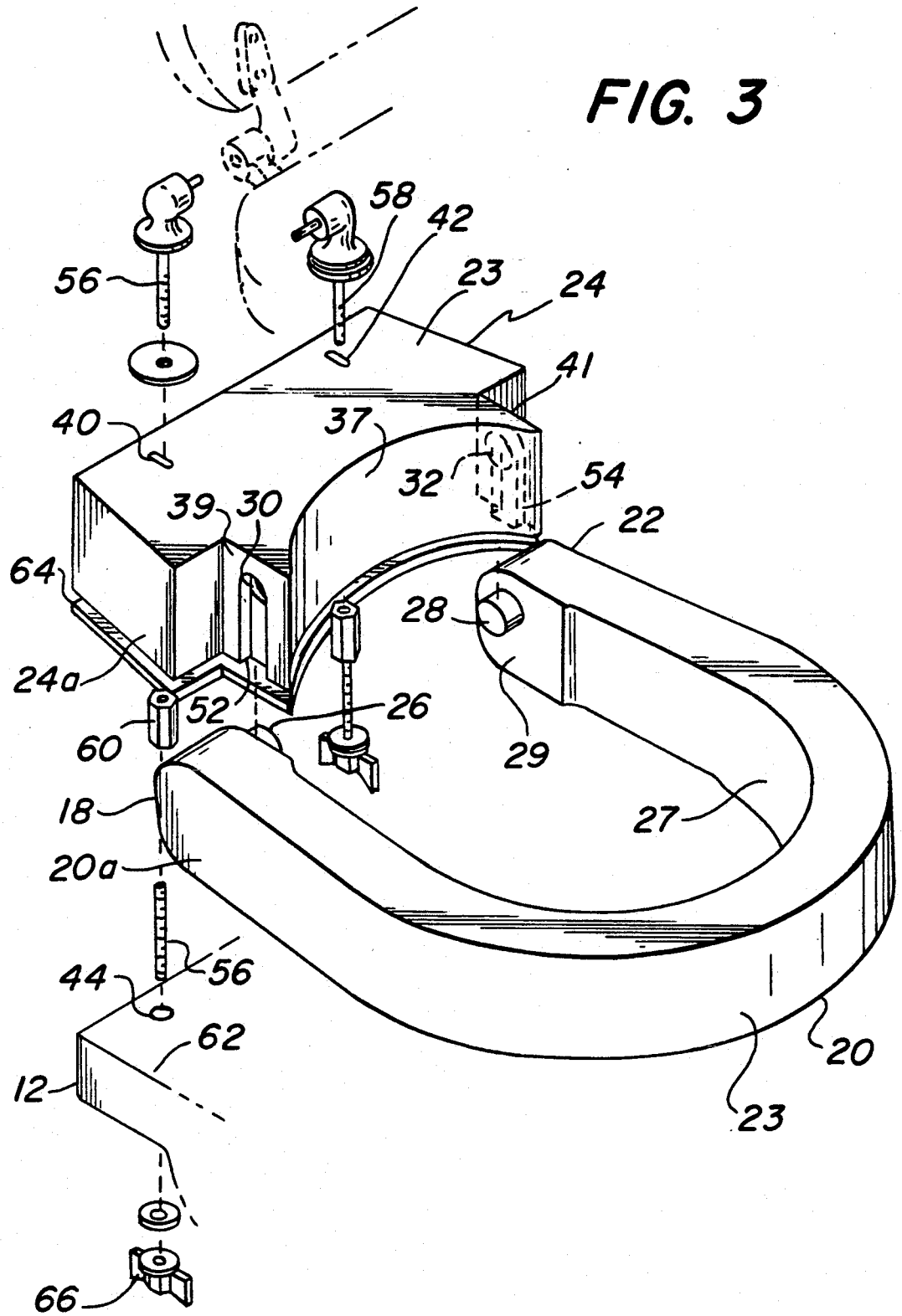
FIG. 3 is a view in perspective of the apparatus of the present invention showing the mounting arrangement, with portions of the toilet, seat and lid being shown in broken lines.

As may be best seen from FIGS. 1, 2 and 3, the outer contour of elevator 20 and mounting block 24 conform to that of toilet 12. The outer curvature of elevator 20 is continued on in the side contour of mounting block 24, as shown at 20*a* and 24*a*. Further, the spacing and location of holes 40 and 42 in mounting block 24 conform to the bolt location for the standard toilet seat, and the holes, such as hole 44, in a standard toilet.

The toilet height conversion apparatus of the present invention may be easily installed on any conventional toilet with the continued use of the conventional toilet seat. Further, there is no more exposed metal hardware than that normally found on a conventional toilet without an elevator or a height conversion apparatus. Further, the present invention provides a toilet height conversion apparatus which does not create any inaccessible cleaning areas or crevices which would be uncleanable and be a possible site for the cultivation of microorganisms.

Figure 8:
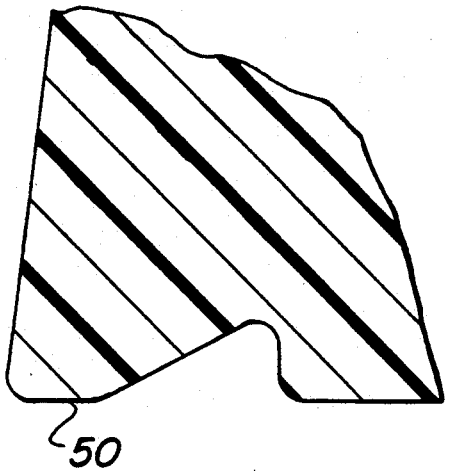
FIG. 8 is a cross-sectional view of a broken away portion of the drip edge illustrated in FIG. 6.

As may be best seen perhaps in connection with FIGS. 2, 5 and 6, the bottom surface 25 of elevator 20 is provided with a splash shield 46 on a centrally disposed portion of the lower surface of generally U-shaped member 20. Drip edges 48 and 50 are provided along lower surface 25 extending from the splash shield 46 towards the ends of generally U-shaped member 20. A detail of a preferred form of drip edge is shown in FIG. 8, although other suitable drip edges may be utilized, including that shown in FIG. 9. The drip edge of the structure of FIG. 8 provides a drip edge which is more easily adapted to the molding process.

The toilet height conversion apparatus of the present invention is easily applied to an existing toilet. In applying it, the existing toilet seat is removed. Preferably, elevator 20 and mounting block 24 are placed upside down, as shown in FIG. 2, and the pivot pins 26 and 28 are slid in channels 52 and 54, respectively, by slighting spreading the free ends of generally U-shaped member 20. U-shaped member 20 has some degree of resiliency, whether it is made of molded plastic, wood or other suitable slightly resilient material. The projecting pins 26 and 28 are slid until they enter into recesses or detents 30 and 32, thereby pivotally connecting generally U-shaped member 20 to mounting block 24. Mounting block 24 and generally U-shaped member 20 are inverted to be right side up, and, as shown in FIG. 3, are mounted to the toilet by use of a pair of extension bolts, one of which is shown in FIG. 3 at 56, which are connected to the conventional toilet seat bolts 56 and 58 by means of connector nuts, one of which is shown at 60. Mounting block 24 is then mounted to the top 62 of toilet 12 with gasket 64 placed between block 24 and the toilet top 62. Gasket 64 may be preferably comprised of a hospital grade white or other suitably colored neoprene.

Toilet seat bolt 56, as extended by means of connector nut 60 and extension bolt 56, are fastened to toilet 12 by use of the standard toilet seat wing nut 66.

Figure 7:
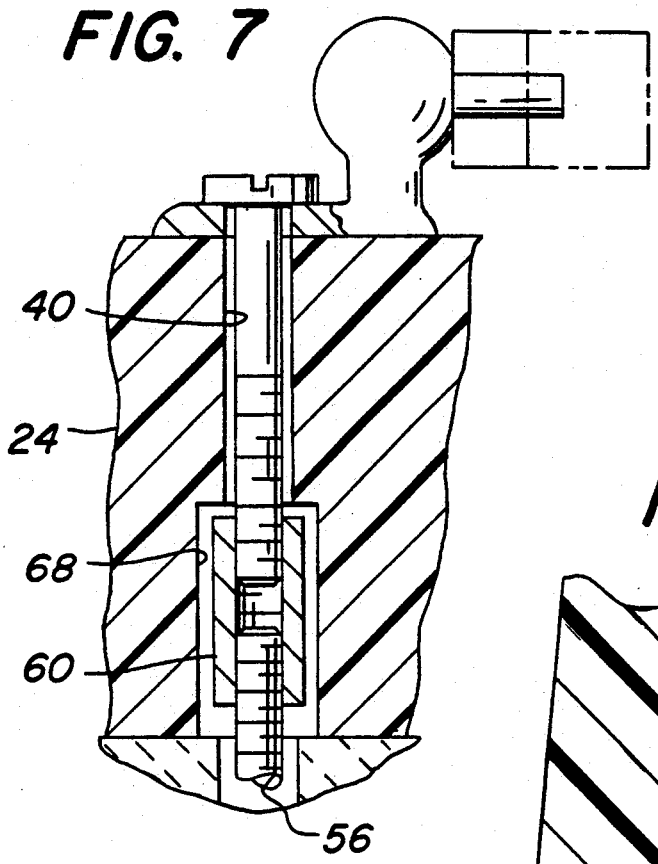
FIG. 7 is a cross-sectional view, partially broken away, illustrating the mounting arrangement of conventional mounting bolts into the apparatus of the present invention.

Referring now to FIG. 7, there is shown a cross-sectional view of the area of mounting block 24 containing hole 40. FIG. 7 also illustrates the use of the present invention with the other commonly available type of commercial seat fastening structure which utilizes a bolt to hold the seat hinge structure to the toilet, as contrasted to that illustrated in FIG. 3, where the toilet seat hinge is integrally formed with the bolt. As may be seen from FIGS. 3 and 7, the present invention is equally adaptable to either type of toilet seat hinge structure bolt arrangement. As may be seen from FIG. 7, the lower portion of hole 40 in mounting block 24 is provided with an enlarged diameter 68 to accommodate connector nut 60. This same enlarged hole structure is illustrated in FIGS. 5 and 6.

Figure 4:
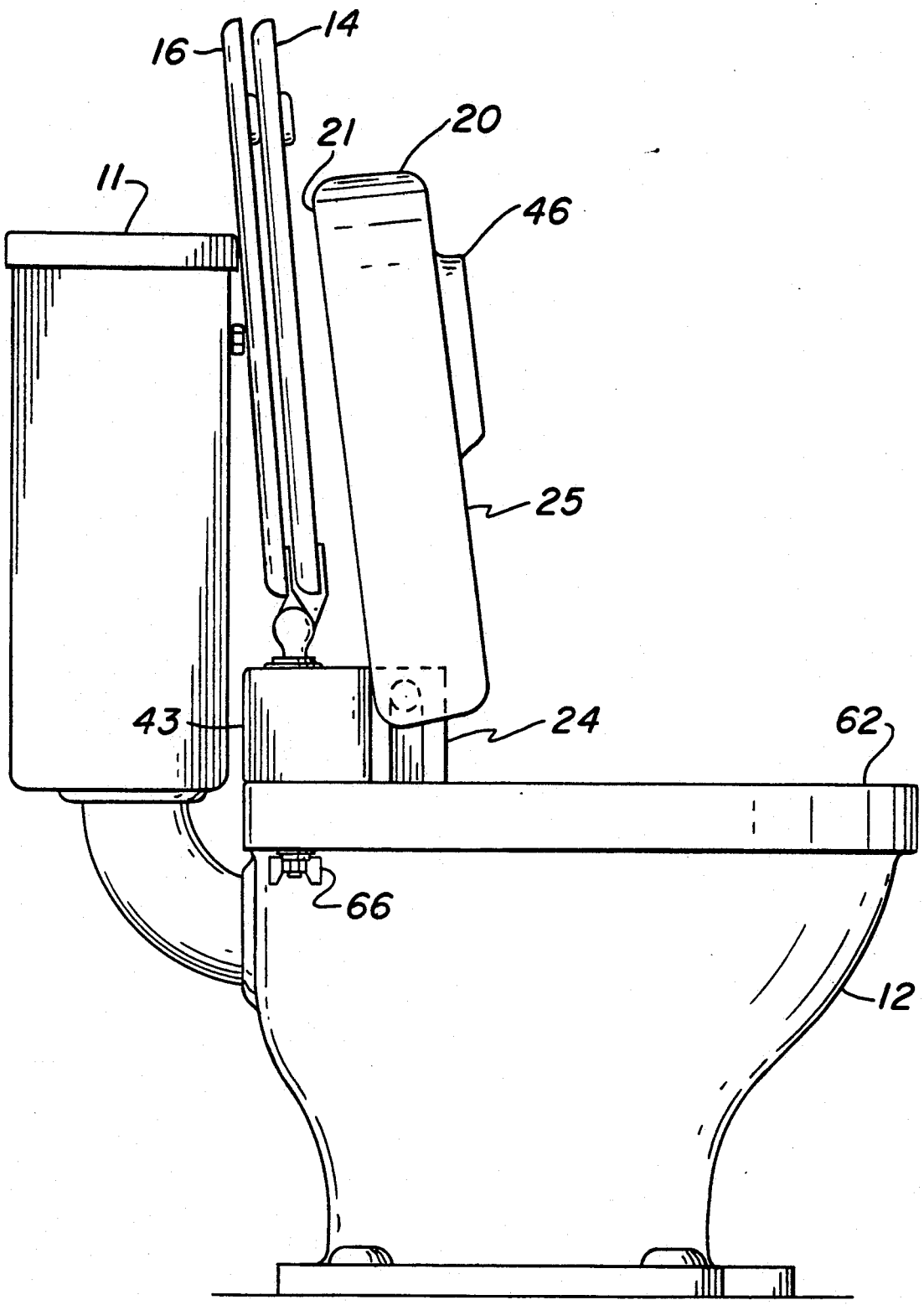
FIG. 4 is a side elevation view of the apparatus of the present invention mounted to a conventional toilet with both the elevator apparatus and the conventional toilet seat and lid in the raised condition.

Referring now specifically to FIG. 4, the elevator 20 with toilet seat 14 and lid 16 are shown in the raised position, wherein lid 16 is resting against water closet 11. In accordance with the present invention, the elevator 20 need only be raised for cleaning. In view of the nature of the structure which closely conforms to the toilet 12 itself, elevator 20 may be in its down position, resting on top 13 of toilet 12 when the toilet is used as a urinal.

Figure 9:
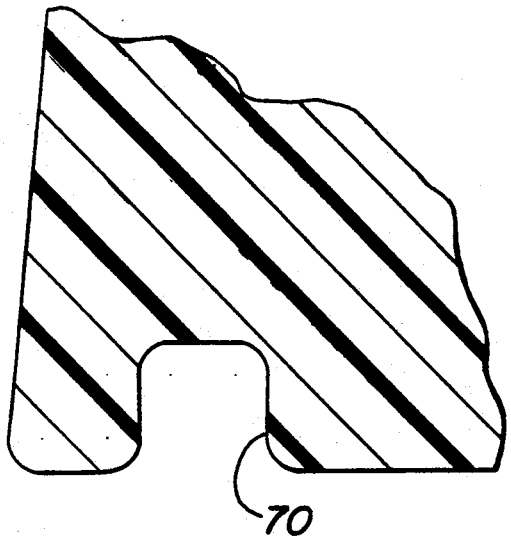
FIG. 9 is a broken away cross-sectional view of another embodiment of a drip edge.

As may be best seen from FIG. 4 taken in conjunction with FIGS. 5 and 6, the splash shield 46 forms a closure between the forward part of elevator 20 and top 13 of toilet 12. Splash shield 46 is particularly advantageous in preventing urine from flowing into the space between elevator 20 and the top 13 of toilet 12 when a user urinates in the sitting position. Extending rearwardly towards the ends of generally U-shaped member 20 from splash shield 46 are drip edges shown as 50 in FIG. 6 and an enlarged cross-section in FIG. 8. An alternate drip edge 70 is illustrated in FIG. 9, which would be particularly useful if the toilet height conversion apparatus were fabricated from wood or otherwise routed into elevator 20.

Figure 10:
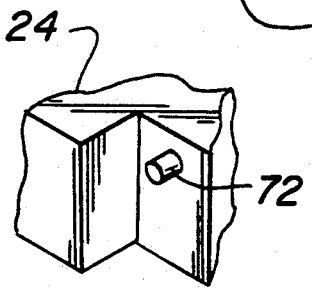
FIG. 10 is a broken away view in perspective of another embodiment of a pivot structure.

Referring to FIG. 10, there is shown an alternate embodiment of the pivot structure between elevator 20 and mounting block 24, wherein a projecting pivot pin or lug 72 is provided on mounting block 24, which would then mate with a recess or detent in the elevator structure.

Referring somewhat more specifically to the structure of elevator 20 and mounting block 24, it may be seen that the elevator 20 is generally U-shaped, with an upper surface 21, a bottom surface 25, an outer surface 23, which includes surface 20*a* as a part thereof, and an inner curvilinear side 27. As previously described, the height of surfaces 23 and 27 is generally selected to be in the range of 3 to 6 inches. At the ends of 18 and 22 on the inner curvilinear sides are a pair of opposing flat faces, one of which is numbered 29, and on which pivot pins for lugs 26 and 28 are formed somewhat superior to the central plane of the elevator piece as may perhaps be best seen in FIGS. 3 and 4.

The mounting block or hinge piece 24, as previously described, is of substantially the same height as elevator piece 20, and has a rear portion 31 which is generally rectangular with the modifications of the sloping sides 24*a*, which conform to the curvilinear outer surface 20*a* of elevator 20. Mounting block 24 is provided with a top surface 23, a bottom surface 33, a rear side 43 and a front side or projection 37, which is shaped curvilinearly, generally following the inner side curve of surface 27 of elevator 20. The projection 37, with its curvilinear surface, is provided with a pair of opposing flat surfaces 39 and 41, which generally match the flat faces 29 of elevator 20, and in which surfaces the grooves 52 and 54 are formed, respectively. As mentioned above, the upper ends of the groove are provided with recesses or detents 30 and 32, respectively, which recesses are located, preferably, above the central plane of the elevator piece which enables the raising of elevator 20 with less rounding of ends 18 and 22 of elevator 20. This provides a more complete appearance, more closely approximating a toilet of increased height.

As previously described, the mounting holes 40 and 42 are spaced the standard distance of the preformed holes in toilets which are utilized to accommodate toilet seats. Accordingly, the present invention accommodates all known standard ways of mounting a seat assembly comprising a seat and lid to a toilet or commode. The slots 50 may preferably be elongated and positioned to accommodate all of them.

As described with respect to the installation procedure, fastening bolts are contained within the mounting block 24, and particularly in view of gasket 64, the bolts are substantially removed from view and ambient atmosphere, at least to the extent of a standard toilet installation. It is understood that the lower projecting portion of the mounting bolt and the fastening wingnut 66 is exposed, but this is below the surface of the toilet.

It will be apparent to those skilled in the art that various changes and modifications may be made to the present invention, within the spirit of the teachings contained herein. For example, various other pivotal arrangements may be utilized. Various changes may be made in the materials, the molding process and the shapes and configurations illustrated herein as the preferred embodiment. For example, it is apparent that the hollow molding process is not essential. This may be made of solid material, and even the low weight advantages may be achieved by utilizing lightweight materials and/or lower density materials, such as foam centers. Other modifications will be apparent to those skilled in the art.

In view of the above, the present invention may be embodied in other specific forms without departing from the spirit or essential attributes thereof and, accordingly, reference should be made to the appended claims, rather than to the foregoing specification as indicating the scope of the invention.

I claim:

1. A toilet seat height conversion apparatus for use in combination with an existing toilet seat, lid and mounting bolts, comprising:

a mounting block having a top and bottom surface defining a predetermined height, said mounting block being provided with aligned holes extending through said surfaces such that the mounting block may be mounted to the upper rear surface of a toilet utilizing the holes provided in the toilet for the mounting of a toilet seat, said block being provided with structure for making a pivotal connection; and a connector nut and extension bolt adapted to be attached to each of said mounting bolts such that each of said mounting bolts may extend through a hole in said top surface and being secured to said toilet utilizing the holes provided in said toilet; and a member having a height substantially the same as the predetermined height of the mounting block with structure for pivotally connecting to the pivotal connection structure for pivotally connecting to the pivotal connection structure of the mounting block; and wherein said existing toilet seat and lid are connected with said mounting bolts to said block such that they may be pivoted to a raised position or to a position overlying said member.

2. A toilet height conversion apparatus in accordance with claim 1 wherein the holes provided through the mounting block are provided with an enlargement extending upwardly from the bottom surface of the mounting block such that said connector nut may be mounted therein.

3. A toilet height conversion apparatus in accordance with claim 1 wherein said mounting block is formed such that portions of said mounting block are hollow.

4. A toilet seat height conversion apparatus in accordance with claim 1 wherein said member having a height substantially the same as the predetermined height of the mounting block is generally "U"shaped.

5. A toilet height conversion apparatus in accordance with claim 4 wherein the structure provided for making a pivotal connection on the mounting block is comprised of a pair of channels with a recessed opening within the channel and said pivotal connection structure on said U-shaped member is comprised of a pin adapted to be received within the recess in the channel.

6. A toilet height conversion apparatus in accordance with claim 5 wherein said generally U-shaped member is provided with a first and second end, said first and second end being resiliently spreadable to enable the making of the pivotal connection between said U-shaped member and said mounting block.

7. A toilet height conversion apparatus in accordance with claim 4 wherein said structure for making a pivotal connection on said mounting block is comprised of a projecting pin and a pivotal connection structure on said generally U-shaped member is a recess for receiving the pin of said mounting block.

8. A toilet height conversion apparatus in accordance with claim 7 wherein said generally U-shaped member is provided with a first and second end, said first and second end being resiliently spreadable to enable the making of the pivotal connection between said U-shaped member and said mounting block.

9. A toilet height conversion apparatus in accordance with claim 8 wherein at least a portion of the aligned holes in said mounting block are enlarged for receiving said connector nuts.

10. A toilet height conversion apparatus in accordance with claim 4 where said generally U-shaped member is provided with a lip along a portion of its lower surface adapted to depend for a predetermined distance into a toilet bowl.

11. A toilet height conversion apparatus in accordance with claim 4 wherein the centrally disposed lower surface of the generally U-shaped member is provided with a drip edge.

12. A toilet height conversion apparatus in accordance with claim 11 wherein said drip edge is provided with a recess on the under surface of the generally U-shaped member at a small predetermined distance from the inner edge of the generally U-shaped member, said small predetermined distance being in comparison to the width of the generally U-shaped member.

13. A toilet height conversion apparatus in accordance with claim 4 wherein said generally U-shaped member is elongated.

14. A toilet height conversion apparatus in accordance with claim 4 wherein said generally U-shaped member is elongated, and wherein said centrally disposed lower surface of the generally U-shaped member is provided with a drip edge.

15. A toilet height conversion apparatus in accordance with claim 4 wherein said generally U-shaped member, when taken in conjunction with said mounting block forms a substantially rounded shape, said generally U-shaped member being provided with a drip edge on its lower surface, centrally disposed on said U-shaped member.

16. A toilet height conversion apparatus in accordance with claim 4 wherein said generally U-shaped member is formed such that at least portions thereof are hollow.

17. A toilet seat height conversion apparatus in accordance with claim 4 wherein said structure of said generally "U" shaped member for pivotally connecting to the pivotal connection structure of the mounting block is a mating structure.

18. A toilet height conversion apparatus, comprising:

an elevator member, which is generally U-shaped, having an upper and a bottom surface, and outer and inner parallel curvilinear sides of a predetermined height, the inner curvilinear side having flat faces opposing each other at the open ends of the U upon which are formed two pivot pins disposed above the central plane of the elevator piece;

a mounting block of substantially the same height as the elevator piece, generally block-shaped, with a rear portion, a top and bottom surface and a front portion which protrudes from the block to form a front side which is curvilinear, and left and right flat faces which mate with the flat faces of the elevator member, each mounting block flat face having formed therein a substantially vertical channel extending for a predetermined length from the bottom and ending in a recess to receive the pivot pins of the elevator member when pressed upwardly into the channel such that said pivot pins and recesses form a pivotal connection, said mounting block further being provided with elongated passages spaced and positioned to be adapted to align with the toilet seat mounting holes in a toilet, and adapted to receive therethrough toilet seat bolts and extension bolts for mounting the toilet seat to the mounting block and toilet.

19. A toilet height conversion apparatus in accordance with claim 18, wherein said toilet seat bolts and extensions are substantially sealed in said passages concealed from view and ambient air.

20. A toilet height conversion apparatus in accordance with claim 18, wherein said elevator member is removable for substitution in its place an elevator of a different curvilinear shape.

21. A toilet height conversion apparatus in accordance with claim 18, wherein said predetermined elevator height is between three and six inches.

* * * * *

UNITED STATES PATENT AND TRADEMARK OFFICE

CERTIFICATE OF CORRECTION

PATENT NO. : 5,251,338

DATED : October 12, 1993

INVENTOR(S) : HOMER E. LIGHT

It is certified that error appears in the above-identified patent and that said Letters Patent is hereby corrected as shown below:

Column 6, line 18, delete "for pivotally connecting".

Column 6, line 19, delete "to the pivotal connection structure".

Signed and Sealed this

Thirtieth Day of November, 1993

Bruce Lehman

*Attest:*

BRUCE LEHMAN

*Attesting Officer*

*Commissioner of Patents and Trademarks*